US006810223B2

(12) United States Patent
Eun et al.

(10) Patent No.: US 6,810,223 B2
(45) Date of Patent: Oct. 26, 2004

(54) DEVELOPING APPARATUS AND METHOD IN IMAGE FORMING APPARATUS

(75) Inventors: Jong-moon Eun, Gyeonggi-do (KR); Duck-hee Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 120 days.

(21) Appl. No.: 10/259,820

(22) Filed: Sep. 30, 2002

(65) Prior Publication Data

US 2003/0118374 A1 Jun. 26, 2003

(30) Foreign Application Priority Data

Dec. 20, 2001 (KR) ..... 2001-81767

(51) Int. Cl.[7] ..... G03G 15/08; G03G 21/00
(52) U.S. Cl. ..... 399/150; 399/252; 399/285
(58) Field of Search ..... 399/149, 150, 399/252, 264, 285, 270, 53

(56) References Cited

U.S. PATENT DOCUMENTS 3,914,045 A * 10/1975 Namiki et al. ..... 399/149
4,500,198 A * 2/1985 Daniels ..... 399/149
4,769,676 A * 9/1988 Mukai et al. ..... 399/150
5,517,289 A * 5/1996 Ito et al. ..... 399/149
5,550,619 A * 8/1996 Komakine et al. ..... 399/149
5,565,969 A * 10/1996 Nozawa ..... 399/150

FOREIGN PATENT DOCUMENTS

JP 08-123196 * 5/1996 ..... G03G/15/08
JP 2001-296742 * 10/2001 ..... G03G/15/08

* cited by examiner

*Primary Examiner*—Sophia S. Chen
(74) *Attorney, Agent, or Firm*—Staas & Halsey LLP

(57) ABSTRACT

A method of forming an image in a developing apparatus of an image forming apparatus and an image forming apparatus including a retrieving/auxiliary developing roller being in contact with the circumference of the photosensitive drum to retrieve or collect toner remaining on a region other than an image region of the circumference of the photosensitive drum and to first develop the latent electrostatic image, a first toner layer control member uniformly re-distributing the remnant toner and electrifying toner on the circumference of the retrieving/auxiliary developing roller and a developing roller having a gap with the circumference of the photosensitive drum to secondly develop the firstly developed latent electrostatic image so as to completely visualize the latent electrostatic image, a supply roller supplying toner to the developing roller, and a second toner layer control member for regularly coating the toner, which is supplied by the supply roller, throughout the circumference of the developing roller and controlling the amount of the electrification of the toner of the developing roller.

18 Claims, 6 Drawing Sheets

DEVELOPING APPARATUS AND METHOD IN IMAGE FORMING APPARATUS

CROSS-REFERENCE TO RELATED APPLICATIONS

This application claims to benefit of Korean Application No. 2001-81767, filed Dec. 20, 2001, in the Korean Industrial Property Office, the disclosure of which is incorporated herein by reference.

BACKGROUND OF THE INVENTION

1. Field of the Invention

The present invention relates to an apparatus for forming an image and a method therefor, and more particularly, to a developing apparatus adapted for use in an image forming apparatus using electrophotography, and a method of forming an image using the developing apparatus.

2. Description of the Related Art

In an image forming apparatus using electrophotography, a photosensitive object is exposed to light, and then, a latent electrostatic image invisible to the naked eye is formed on a portion of the photosensitive object according to image information obtained from an original copy or a predetermined source. Next, a developing solution (toner) is applied onto the portion of the photosensitive object to visualize the latent electrostatic image. Then, the visualized image is transferred to and fixed onto paper.

The image forming apparatus using electrophotography is classified into a wet-type image forming apparatus and a dry-type image forming apparatus according to the type of toner used. The wet-type image forming apparatus uses a mixture of powdered toner and a volatile liquid carrier as a developing solution, whereas the dry-type image forming apparatus uses only powdered toner.

In the image forming apparatus using electrophotography, the developing solution is supplied to the photosensitive object to visualize the latent electrostatic image formed thereon. Specifically, FIGS. 1 and 2 are cross-sectional views of conventional developing apparatuses in the dry-type image forming apparatus using electrophotography.

Referring to FIG. 1, a charging roller 12 charges the circumference of a photosensitive drum 10 with an electric charge. When a laser beam containing image information is scanned on a portion of the charged circumference of the photosensitive drum 10 by a laser scanning unit 14, a static electric charge of the portion is removed, and then, a latent electrostatic image corresponding to the image information is formed on the circumference of the photosensitive drum 10. The latent-electrostatic image can be visualized by a developing roller 16 supplying toner charged with the same or opposite electric charge to the circumference of the photosensitive drum 10. The developing roller 16 is supplied with toner by a supply roller 20. A portion of the supply roller 20 is in contact with the circumference of the developing roller 16, and another portion of the supply roller 20 is in contact with toner 18.

Above the developing roller 16, a toner layer control unit 22 is installed adjacent to the circumference of the developing roller 16 so as to control a toner layer formed on the circumference of the developing roller 16. Also, below the developing roller 16, first and second seal members 24 and 28 are installed to seal a first case 20 containing the toner 18 and the supply roller 20, and a bottom of the first case 26 is connected to the toner layer control unit 22. In an opposite side of the developing roller 16, a waste toner storage member 32, which stores waste toner collected from the circumference of the photosensitive drum 10 after the latent electrostatic image has been transferred onto paper (not shown), is disposed in a second case 34 having the charging roller 12.

Also, to prevent the leakage of the waste toner, a third seal member 30 is connected to a bottom of the second case 34 while being in contact with the circumference of the photosensitive drum 10. A cleaning blade 36, which is used to remove the waste toner remaining on the circumference of the photosensitive drum 10, is installed adjacent to the charging roller 12 in the waste toner storage member 32 and between the charging roller 12 and the third seal member 30. Here, reference numeral 38 denotes a lid of a toner storage member 40 of the first case 26.

FIG. 2 is a cross-sectional view of another conventional developing apparatus in an image forming apparatus. Referring to FIG. 2, a charging apparatus 52, which has the same operations as the charging roller 12 of FIG. 1, is installed adjacent to a photosensitive drum 50. In the front of the charging apparatus 52 is installed a discharging lamp 54 removing an electric charge from the circumference of the photosensitive drum 50 prior to charging the photosensitive drum 50. When an exposure apparatus 21 emits light on the circumference of the photosensitive drum 50 charged by the charging apparatus 52, a latent electrostatic image is formed on the circumference of the photosensitive drum 50. The formed latent electrostatic image can be visualized by a developing apparatus 56 installed adjacent to the photosensitive drum 50.

A toner hopper 60 containing toner 58 is installed in an upper portion of a case 56*a*. A developing roller 62, which supplies the toner 58 to the photosensitive drum 50 so as to visualize the latent electrostatic image, is installed at an aperture at a lower portion of the case 56*a*. Between the developing roller 62 and a toner outlet of the toner hopper 60 is installed a supply roller 64 supplying the toner 58 to the developing roller 62. An upper side of the circumference of the developing roller 62 is in contact with a toner layer control unit 66 controlling an amount of the toner 58 and toner layers formed on the developing roller 62, and a lower side of the developing roller 62 is in contact with a sealing blade 68 preventing the leakage of the toner 58 out of the case 56*a*.

A cleaning roller 70 is installed at an upper aperture of the case 56*a* and is separated from a lower aperture of the case 56*a* by a predetermined distance. The cleaning roller 70 is spaced-apart from the photosensitive drum 50 by about 200 $\mu$m and is used to remove the toner 58 remaining on the circumference of the photosensitive drum 50. The upper and lower sides of the circumference of the cleaning roller 70 are in contact with a toner layer control unit 66, which controls the amount of the toner 58 and the toner layers, and a sealing blade 74, which prevents the leakage of the toner 58, respectively. The developing roller 62 and the cleaning roller 70 are connected to a power source 76 supplying a predetermined cleaning and developing voltage thereto so as to remove the toner 58 remaining on the circumference of the photosensitive drum 50, supply the toner 58 to the circumference of the photosensitive drum 50, and visualize the latent electrostatic image formed on the circumference of the photosensitive drum 50.

The conventional developing apparatus of FIG. 1 may perform an excellent cleaning operation since the toner remaining on the circumference of a photosensitive drum is mechanically removed by a blade when a latent electrostatic image is transferred on paper and then cleaned. However, the conventional developing apparatus of FIG. 1 is disadvantageous in that it is difficult to minimize the conventional developing apparatus in size since a region for additionally storing waste toner is required, there is a limitation in reducing at toner consumption due to the waste toner, and additional devices are further needed to collect and store the waste toner when the image forming apparatus is manufactured. These disadvantages would cause an inconvenience of a user and contamination of an image.

On the other hand, the conventional developing apparatus of FIG. 2 may perform less excellent cleaning operations than that of the developing apparatus of FIG. 1, but is advantageous in that it does not require an additional space for storing the waste toner. However, the developing apparatus of FIG. 2 has a low efficiency in collecting the waste toner from a photosensitive drum, thereby still causing the contamination of an image, such as a ghost image, due to a poor cleaning operation.

SUMMARY OF THE INVENTION

To solve the above and other problems, it is an object of the present invention to provide a developing apparatus adapted for use in an image forming apparatus that does not need any additional cleaning device and a waste toner storage space, thereby reducing the image forming apparatus in size and consumption of toner by a significant amount, and that is durable to generate an image of good quality since the contamination of an image generated due to the poor cleaning operation is prevented.

It is another object of the present invention to provide a method of forming an image using a developing apparatus in an image forming apparatus.

Additional objects and advantages of the invention will be set forth in part in the description which follows and, in part, will be obvious from the description, or may be learned by practice of the invention.

To achieve the above and other objects, there is provided a developing apparatus adapted for use in an image forming apparatus capable of visualizing a latent electrostatic image formed on a circumference of a photosensitive drum. The developing apparatus includes a retrieving/auxiliary developing roller being in contact with the circumference of the photosensitive drum to retrieve and collect toner remaining around a region of the circumference of the photosensitive drum and to first develop the latent electrostatic image, a first toner layer control member uniformly re-distributing the retrieved (remnant) toner and regulating the electrification of the remnant toner on the circumference of the retrieving/auxiliary developing roller, a developing roller having a gap with the circumference of the photosensitive drum and secondly developing the firstly developed latent electrostatic image so as to completely visualize the latent electrostatic image, a supply roller supplying new toner to the developing roller, and a second toner layer control member regularly and uniformly coating the new toner, which is supplied by the supply roller, throughout the circumference of the developing roller and regulating the amount of the electrification of the new toner of the developing roller.

The developing apparatus includes a first seal member sealing the retrieving/auxiliary developing roller, and toner supplying elements formed between the developing roller and the retrieving/auxiliary developing roller, and a second seal member sealing the developing roller, and the case containing the toner supplying elements.

The developing apparatus includes a power source supplying a predetermined voltage to the retrieving/auxiliary developing roller so as to retrieve (collect) the toner remaining on peripheral regions other than an latent electronstatic image region of the circumference of the photosensitive drum, and to firstly develop the latent electrostatic image.

The developing apparatus includes another power source supplying the developing roller with a developing voltage having an absolute value being greater than that of the latent electrostatic image. The developing apparatus includes another power source supplying the first toner layer control member with a first control voltage having an absolute value or greater than that of the predetermined voltage supplied to the retrieving/anxiliary developing roller.

The developing apparatus includes another power source supplying the supply roller and the second toner layer control member with a supplying voltage and a second control voltage each having an absolute value being equal to or greater than the absolute value of the voltage supplied to the developing roller.

The developing apparatus includes another power source connected to the supply roller and the second toner layer control member to supply a developing voltage to the developing roller so that the absolute value of an electric potential of the circumference of the developing roller is greater than the absolute value of an electric potential of the latent electrostatic image, and to supply the supply roller and the second toner layer control member with the supplying voltage and the second voltage, respectively, each having an absolute value being equal to or greater than that of the developing voltage supplied to the developing roller.

An electric potential $V_{B1}$ of the circumference of the retrieving/auxiliary developing roller has a relationship with an electric potential $V_L$ of the latent electrostatic image formed on the circumference of the photosensitive drum and an electric potential $V_0$ around the latent electrostatic image as follows:

$$|V_L|<|V_{B1}|<|V_0|]$$

The power source supplying the developing voltage to the developing roller includes DC and AC power sources.

The power source, which is connected to the developing roller, the supply roller and the second toner layer control member, includes the AC power source, a first DC power source, and a second DC power source. The power source supplies the developing voltage made by overlapping DC and AC voltages of the AC power source and the second DC power source, respectively, to the developing roller. The first DC power source and the second DC power source supplies the developing roller and the second toner layer control member with a developing voltage and a second control voltage, respectively, each having a DC voltage having absolute value being equal to greater than the absolute value of a DC voltage applied to the developing roller.

To achieve the above and other objects, there is provided a method of forming an image using a developing apparatus in an image forming apparatus. The method includes primarily developing a latent electrostatic image with the retrieved toner while retrieving (collecting) toner remaining around the latent electrostatic image formed on the circumference of a photosensitive drum, secondly developing and completely visualizing the latent electrostatic image with new toner while keeping a predetermined gap between the developing roller and the circumference of the photosensitive drum, and supplying the new toner to the developing roller. In the method, the circumference of the photosensitive drum is charged with a first electric potential in response to an image forming initial signal, a predetermined region of the circumference of the photosensitive surface, which is charged with the first electric potential, is exposed to light to have a second electric potential, and the circumference of the retrieving/auxiliary developing roller is charged with a third electric potential, wherein the first, second, and third electric potentials have the following relationship:

$$|\text{second electric potential}|<|\text{third electric potential}|<|\text{first electric potential}|$$

The retrieving/auxiliary developing roller is set to have a predetermined linear velocity with respect to the circumference of the photosensitive drum. The first control voltage supplied to the first toner layer control member has a larger absolute value than the predetermined voltage supplied to the retrieving/auxiliary developing roller so as to keep or enhance friction electrification characteristics of toner.

The developing voltage supplied to the developing roller has an absolute value of the electric potential of the circumference of the developing roller greater than that of the predetermined voltage of the circumference of the retrieving/auxiliary developing rollers, and the supplying voltage and the second control voltage, which are equal to or greater than the developing voltage applied to the developing roller, are supplied to the supply roller and the second toner layer control member, respectively.

To achieve the above and other objects, there is provided a method of forming an image in a developing apparatus of in an image forming apparatus. The method includes charging the circumference of the photosensitive drum with a first electric potential in response to an image forming initial signal, forming a latent electrostatic image of a second electric potential on the circumference of the photosensitive drum, which has been charged with the first electric potential, partially visualizing the latent electrostatic image, completely visualizing the partially visualized latent electrostatic image, and transferring and fixing the completely visualized latent electrostatic image onto paper.

The completely visualizing of the partially visualized latent electrostatic image includes firstly developing the latent electrostatic image while retrieving (collecting) remnant toner from a non-image region other than an image region of the circumference of the photosensitive drum, which has been charged with the first electric potential.

The retrieving of the remnant toner and firstly developing the latent electrostatic image are performed using the retrieving/auxiliary developing roller whose circumference has been charged with a third electric potential and that satisfies the following:

$$|\text{second electric potential}|<|\text{third electric potential}|<|\text{first electric potential}|$$

The completely visualizing of the partially visualized latent electrostatic image includes secondly developing the firstly developed latent electrostatic image using the developing roller charged with the developing voltage generated by overlapping a DC voltage and an AC voltage.

As described above, in a developing apparatus of an image forming apparatus according to embodiments of the present invention, the remnant toner remaining along the circumference of a photosensitive drum is retrieved to be used in developing a latent electrostatic image. Thus, since no additional cleaning devices are required and no waste toner is generated, the developing apparatus does not require an additional space for storing the waste toner, thereby reducing the developing apparatus in size. Also, since the remnant toner is used again, the consumption of toner decreases. Further, a retrieving ratio of the remnant toner can be increased by controlling a retrieving/auxiliary developing roller to be in contact with a photosensitive drum, and an image of high definition can be formed while the retrieving/auxiliary developing roller is not in contact with a developing roller. Because there is no need of an additional space for storing the waste toner, it is possible to prevent any inconvenience of a user and the contamination of an image or the pollution of environments due to the leakage of the waste toner. Lastly, the developing apparatus is improved in structure and functions so that the life of the developing apparatus can be lengthened.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
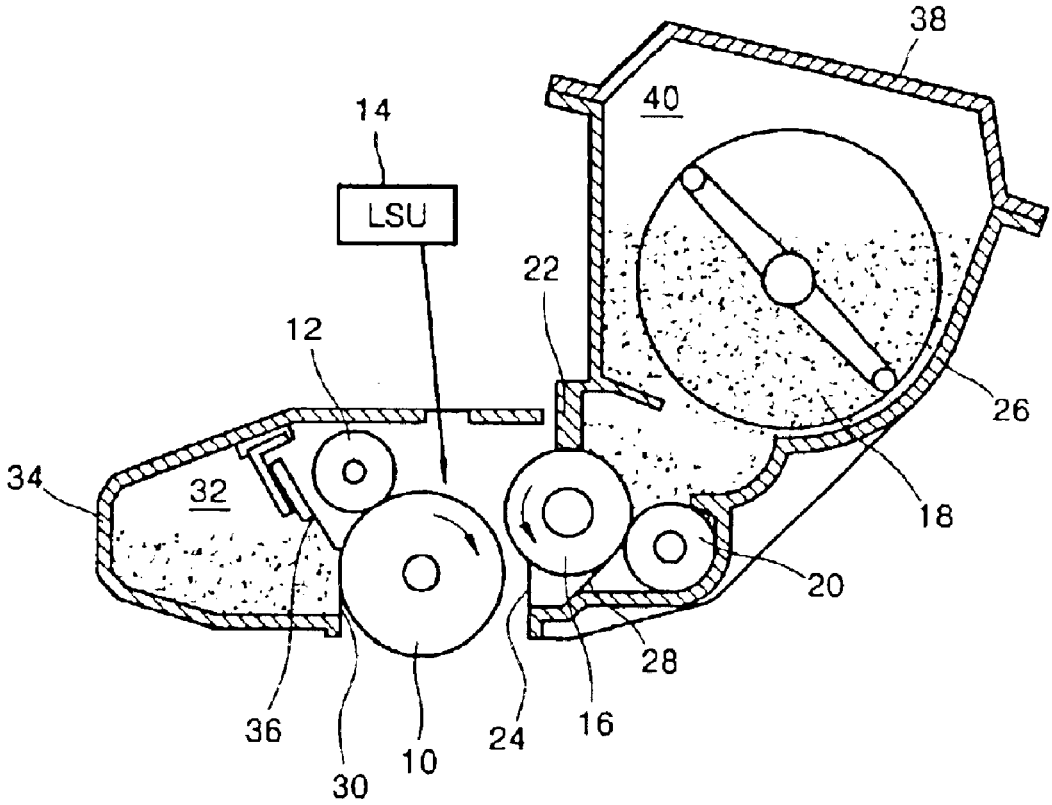
FIG. 1 (PRIOR ART)
FIG. 1 is a cross-sectional view of a conventional developing apparatus for use in an image forming apparatus using electrophotography.
Figure 2:
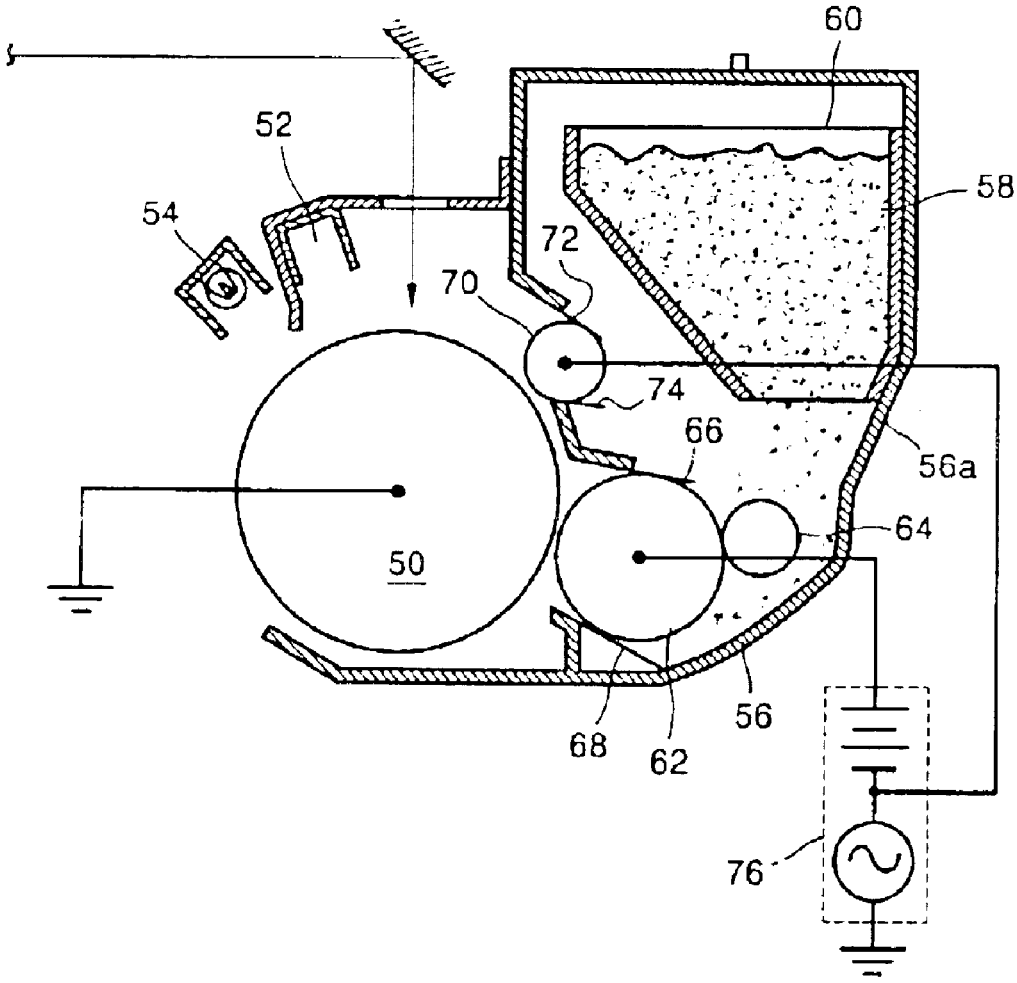
FIG. 2(PRIOR ART)
FIG. 2 is a cross-sectional view of another conventional developing apparatus for use in an image forming apparatus using electrophotography.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 3:
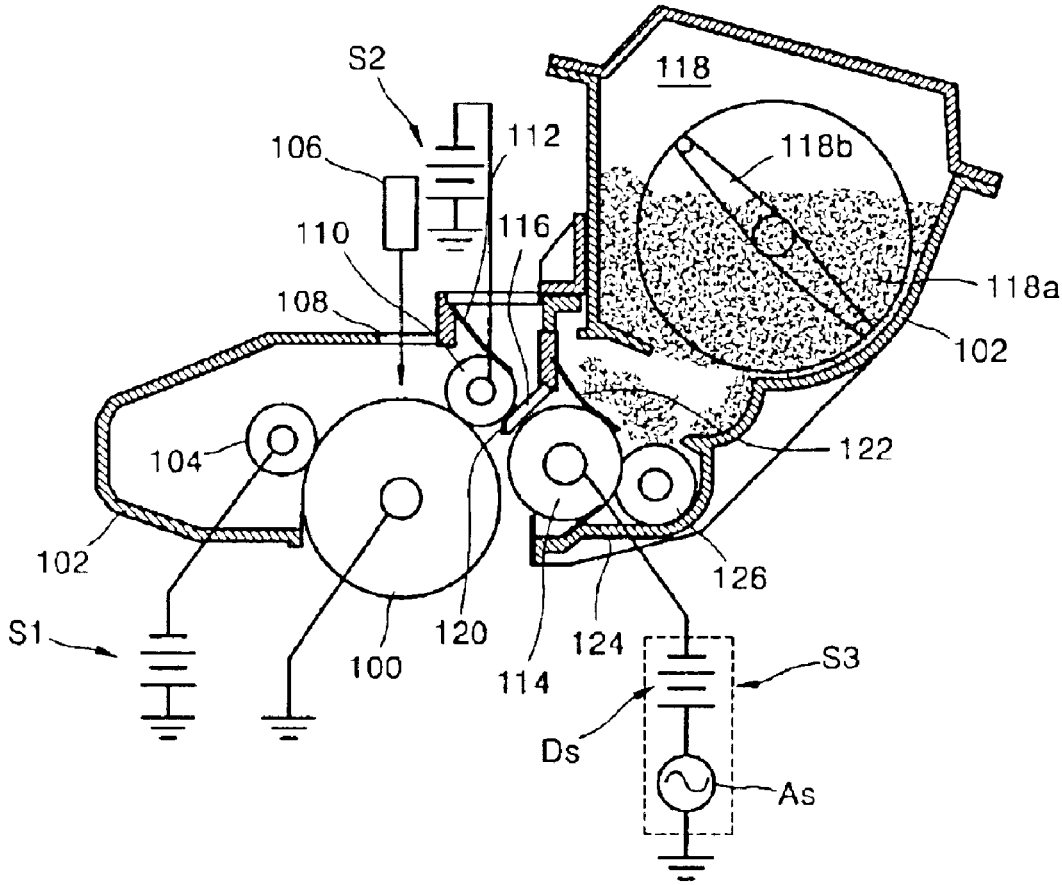
FIGS. 3 through 5 are cross-sectional views of a developing apparatus in an image forming apparatus using electrophotography according to embodiments of the present invention.

Referring to FIG. 3, a developing apparatus adapted for use in an image forming apparatus according to a first embodiment of the present invention includes various members visualizing an image, which is recorded on an original copy or output from a computer connected to the image forming apparatus, on a circumference of a photosensitive drum 100 on which a latent electrostatic image corresponding to the image is formed when light containing information about the image is radiated thereon. These various members, including the photosensitive drum 100, are built in a case 102.

Specifically, a charging roller 104, which charges a portion of the photosensitive drum 100 with an electric charge in response to a print initial signal, is installed to rotate while being in contact with the circumference of the photosensitive drum 100. Here, the charging roller 104 charging the circumference of the photosensitive drum 100 with the electric charge may be replaced with another charging device charging the circumference of the photosensitive drum 100 without being in contact with the circumference of the photosensitive drum 100. The charging roller 104 is connected to a first power source S1 so as to charge the circumference of the photosensitive drum 100 with the electric charge. The circumference of the photosensitive drum 100 is charged with a first electric potential, for example, −700 V, via the charging roller 104. Since the circumference of the charging roller 104 is in contact with that of the photosensitive drum 100, the photosensitive drum 100 is rotated in response to the print initial signal and, then, the circumference of the photosensitive drum 100 is charged.

A charged portion of the circumference of the photosensitive drum 100 is exposed to light L emitted from a light source, for example, a light scanning unit 106 having a light emitting diode (LED) or semiconductor laser diode. As a result, a latent electrostatic image corresponding to the image information is formed on the circumference of the photosensitive drum 100. The light L emitted from the light source is scanned on a portion of the circumference of the photosensitive drum 100 via a light-projecting window 108 formed in a case 102.

A retrieving/auxiliary developing roller 110 is installed to be in contact with a portion of the photosensitive drum 100 on which the light L is radiated by the light-scanning unit 106. The retrieving/auxiliary developing roller 110 is a conductive elastic roller. For example, the retrieving/auxiliary developing roller 110 may have a predetermined surface resistance of about $10^8$ Ω or less, preferably, a surface resistance of $10^7$ Ω, and have a surface hardness of about 60 or less, preferably, a surface hardness of 50 (Askev C hardness). The retrieving/auxiliary developing roller 110 retrieves remnant toner left along the circumference of the photosensitive drum 100 on which the latent electrostatic image is formed after the previous operation of forming a previous image has been performed, and uses the retrieved toner to primarily developing the latent electrostatic image. As a result, the latent electrostatic image is partially visualized by the primary development thereof.

Hereinafter, with reference to the accompanying drawings, a process of retrieving the remnant toner from the circumference of the photosensitive drum 100 using the retrieving/auxiliary developing roller 110 and primarily developing the latent electrostatic image with the retrieved toner is explained in detail.

The circumference of the photosensitive drum 100, which is charged with a predetermined electric potential $V_0$ by the charging roller 104, is exposed to the light L scanned by the light scanning unit 106. As a result, the exposed portion (an image region) of the circumference, i.e., the portion where a latent electrostatic image is formed, has a relatively lower electric potential $V_L$ than the electric potential $V_0$ of the non-exposed portions (a non-image region) in absolute value, i.e., $|V_L|<|V_0|$.

To retrieve the remnant toner from the circumference of the photosensitive drum 100 having the electric potential $V_0$ or $V_L$ as or described above, especially, from the non-exposed portion, the circumference of the retrieving/auxiliary developing roller 110 may have an electric potential $V_{B1}$ of −300V that is a value between the electric potential $V_L$ of −100V of the exposed portion and the electric potential $V_0$ of −700V of the non-exposed portion, for example. That is, $|V_L|<|V_{B1}|<|V_0|$. The electric potential $V_{B1}$ is generated by a second power supply S2, which is connected to the retrieving/auxiliary developing roller 110.

Due to a difference between the electric potentials of the circumferences of the photosensitive drum 100 and the retrieving/auxiliary developing roller 110, the toner remaining on the non-exposed portion of the photosensitive drum 100 is transferred to the circumference of the retrieving/auxiliary developing roller 110 when the circumferences of the photosensitive drum 100 and the retrieving/auxiliary developing roller 110 come into contact with each other. On the other hand, the toner remaining on the exposed portion of the photosensitive drum 100 is not transferred to the retrieving/auxiliary developing roller 110. Meanwhile, due to the rotation of the retrieving/auxiliary developing roller 110, the remnant toner, which has been transferred to the circumference of the retrieving/auxiliary developing roller 110, comes in contact with a first toner layer control member 112 disposed to be in contact with the circumference of the retrieving/auxiliary developing roller 110 and between the case 102 and the circumference of the retrieving/auxiliary developing roller 110. Therefore, the first layer toner control member 112 controls (regulates) toner layers and the amount of electrification of the remnant toner that was transferred to the circumference of the retrieving/auxiliary developing roller 110. The first toner layer control member 112 is an elastic blade, one end of which is attached to an inner side of the case 102, and the other end of which is in contact with the circumference of the retrieving/auxiliary developing roller 110.

As described above, the electric potential $V_L$ of the exposed portion of the circumference of the photosensitive drum 100 on which the latent electrostatic image is formed, has an absolute value which is lower than that of the electric potential $V_{B1}$ of the circumference of the retrieving/auxiliary developing roller 110. Therefore, the remnant toner, which moved to and was evenly redistributed along the circumference of the retrieving/auxiliary developing roller 110, moves to the image region of the circumference of the photosensitive drum 100 on which the latent electrostatic image is formed. As a result, the image region of the circumference of the photosensitive drum 100 on which the latent electrostatic image is formed, is developed primarily. However, the amount of the remnant toner collected from the non-exposed portion of the circumference of the photosensitive drum 100 is not much of the latent electrostatic image. Thus, the amount of the toner moving from the circumference of the retrieving/auxiliary developing roller 110 to the exposed portion of the circumference of the photosensitive drum 100 on which the latent electrostatic image is formed, is not sufficient to completely develop the latent electrostatic image. For this reason, the latent electrostatic image is only partially visualized during primary developing of the latent electrastatic image by the retrieving/auxiliary developing roller 110.

A linear velocity of the retrieving/auxiliary developing roller 110 is set to be the same as or larger than that of the photosensitive drum 100 so that a retrieving ratio of the remnant toner from the photosensitive drum 100 can be improved. For this end, a linear velocity ratio between the retrieving/auxiliary developing roller 110 and the photosensitive drum 100 is set to be above 1, preferably, 1.0–2.0. Also, the surface resistance of the retrieving/auxiliary developing roller 110 is $5\times10^8$ Ω or less at the normal temperature and humidity in consideration of the retrieving ratio of the remnant toner from the retrieving/auxiliary developing roller 110. In the event that the surface resistance is larger than $5\times10^8$ Ω, the developing efficiency may be rapidly lowered at a lower temperature and humidity, thereby causing the deterioration of a developed image.

Referring to FIG. 3, a developing roller 114 is disposed adjacent to the retrieving/auxiliary developing roller 110. The developing roller 114 supplies new toner to the circumference of the photosensitive drum 100 to completely develop the primarily developed latent electrostatic image, which is formed on the circumference of the photosensitive drum 100. The developing roller 114 is made of aluminum or a rubber material. The surface roughness of the developing roller 114 is about 3.0 or less (preferably, 1–2.5) when it is an aluminum developing roller and its circumference is electroplated with nickel, whereas the developing roller 114 has a predetermined hardness, e.g., 60 or less, and a predetermined surface resistance, e.g., $5\times10^6$ Ω or less, when it is a rubber developing roller.

There is a predetermined gap between the circumference of the developing roller 114 and that of the photosensitive drum. The gap is about 250 μm, enough to move the new toner from the circumference of the developing roller 114 to the circumference of the photosensitive drum 100. This gap is kept to be constant until the developing roller 114 completes developing of the latent electrostatic image. The toner is transferred from the circumference of the developing roller 114 to the circumference of the photosensitive drum 100 after passing the gap.

When a developing voltage is supplied to the developing roller 114, the electric potential of the circumference of the developing roller 114 is controlled to be higher in absolute value than that of the primarily developed latent electrostatic image that is formed on the circumference of the photosensitive drum 100. The developing voltage is formed with a DC voltage overlapped with an AC voltage. The overlapped voltage is supplied from a third power source S3 including a DC power source Ds and an AC power source As. For example, the DC voltage of −250 V is supplied from the DC power source Ds, and the AC voltage having a frequency of 2 KHz and a peak-to-peak voltage Vp-p of 1.8 kV is supplied from the AC power source As. The voltage is kept to be regular by reducing a duty ratio of the overlapped voltage when the developing voltage supplied to the developing roller 114 is high, or increasing the duty ratio when the voltage is low. Here, the duty ratio is 50% or less, preferably, 20–40%.

Meanwhile, the toner transferred to the circumference of the developing roller 114 from that of a supply roller 126 is charged due to friction between these circumferences or implantation of an electric charge and then has a predetermined electric potential. A surface density of the toner supplied to the circumference of the developing roller 114, i.e., the amount of toner per unit area, has a predetermined value when the circumference of the developing roller 114 passes through second toner layer control member 122. A surface density is 0.4–0.9 mg/cm$^2$, for example. Also, the supplied toner is charged with a predetermined amount of electrification (q/m), for example, −5–20 μC/g.

As previously mentioned, as the developing voltage made by overlapping the DC and AC voltage is supplied to the developing roller 114, the toner is evenly developed throughout the exposed portion having the primarily developed latent electrostatic image, which is formed on the circumference of the developing roller 114. As a result, the primarily developed latent electrostatic image is completely visualized, and further, a full image, which is shaped to be same as the primarily developed latent electrostatic image, is formed on the circumference of the photosensitive drum 100. Therefore, the latent electrostatic image, which is formed on the circumference of the photosensitive drum 100, can be developed two times, and thus, the visualized image becomes the full image of appropriate density.

To transfer the toner from the circumference of the developing roller 114 to that of the photosensitive drum 100, the electric potential of the toner coated on the circumference of the developing roller 114 is greater in absolute value than the electric potential of the primarily developed latent electrostatic image on the circumference of the photosensitive drum 100. Therefore, the developing voltage is supplied to the developing roller 114 so that its electric potential is greater than that of the primarily developed latent electrostatic image of the circumference of the photosensitive drum 100 in absolute value.

The developing roller 114 is separated from the retrieving/auxiliary developing roller 110 by a partition 116. Due to the partition 116, the retrieving/auxiliary developing roller 110 is also separated from a toner storage 118 containing toner 118*a* supplied to the developing roller 114. Reference numeral 118*b* denotes an agitator stirring the toner 118*a*. A gap between the partition 116 and the retrieving/auxiliary developing roller 110 is sealed by a first seal member 120. The first seal member 120 is an elastic blade having one end attached to the partition 116 and the other end being in contact with the retrieving/auxiliary developing roller 110. Above the developing roller 114 is installed the second toner layer control member 122 evenly coating the toner, which is supplied to the developing roller 114, on the circumference of the developing roller 114. The second toner layer control member 122 is an elastic blade having one end attached to a fixed member, which connects the partition 116 and the case 102, and the other end being in contact with the circumference of the developing roller 114. A second seal member 124 is installed between the developing roller 114 and the bottom of the case 102. The material and structure of the second seal member 124 are the same as those of the first seal member 120. The supply roller 126 is disposed between the developing roller 114 and the case 102.

The supply roller 126 supplies the toner from the toner storage 118, which is disposed above the developing roller 114, to the circumference of the developing roller 114 while rotating due to contact with the developing roller 114. The toner, which is supplied to the circumference of the developing roller 114 by the supply roller 126, is charged due to the friction between the circumferences of the developing roller 114 and the supply roller 114, or the implantation of the electric charge. Then, the charged toner is evenly coated and distributed on the circumference of the developing roller 114 by the second toner layer control member 122.

As described above, the image, which is formed on the circumference of the photosensitive drum 100, is completely visualized by the retrieving/auxiliary developing roller 110 and the developing roller 114. Next, the image is transferred on paper (not shown) when the circumference of the photosensitive drum 100 contacts the paper. Thereafter, the paper on which the image is transferred passes through a heating roller (not shown). Then, the toner forming the image is fixed on the paper, thereby permanently forming the image on the paper.

Then, after the circumference of the photosensitive drum 100 is neutralized by a neutralizing apparatus (not shown), a process of charging the circumference of the photosensitive drum 100 by the charging roller 104 to form another image is repeated a desired number of times.

Figure 4:
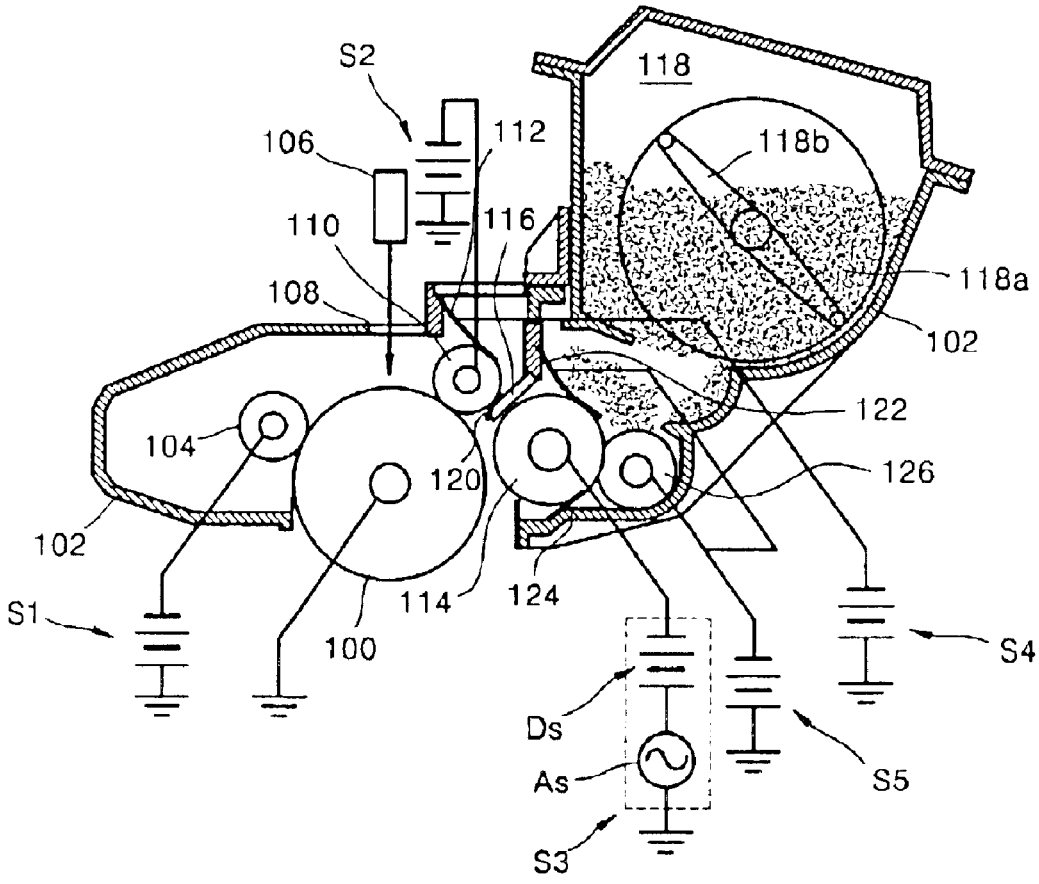

As shown in FIG. 4, the structure of the developing apparatus according to a second embodiment of the present invention, is almost the same as the structure of the first embodiment. A difference between the first and second embodiments is that the second toner layer control member 122 and the supply roller 126 are connected to a fifth power source S5 as a common power source, and the first toner layer control member 12 is connected to a fourth power source S4. The fourth power source S4 supplies a first control voltage to the first toner layer control member 112. The first control voltage is equal to or greater than the voltage supplied to the retrieving/auxiliary developing roller 110 in the absolute value. If the first control voltage is supplied to the first toner layer control member 112, it is possible to keep or enhance friction and electrification characteristics of toner.

When the supplying voltage is applied to the supply roller 126 from the fifth power source S5, the circumference of the supply roller 126 has a predetermined electric potential corresponding to the supplying voltage. At this time, since toner moves from the circumference of the supply roller 126 to the circumference of the developing roller 114, the absolute value of the electric potential of the circumference of the supply roller 126 is greater than that of the electric potential of the developing voltage of the circumference of the developing roller 114. Thus, the absolute values of the supplying voltage and a second control voltage, which are supplied to the supply roller 126 and the second toner layer control member 122, respectively, from the fifth power source S5, are the same as or greater than that of the developing voltage applied to the developing roller 114. For instance, assuming that the developing voltage supplied to the developing roller 114 is −250 V, the supplying voltage supplied to the supply roller 126 is at least −250 V or lower.

As a result, the toner fixed along the circumference of the supply roller 126 is transferred to the circumference of the developing roller 114 due to a difference of the electric potentials or a mechanical supply of the toner between the supply roller 126 and the developing roller 114.

Figure 5:
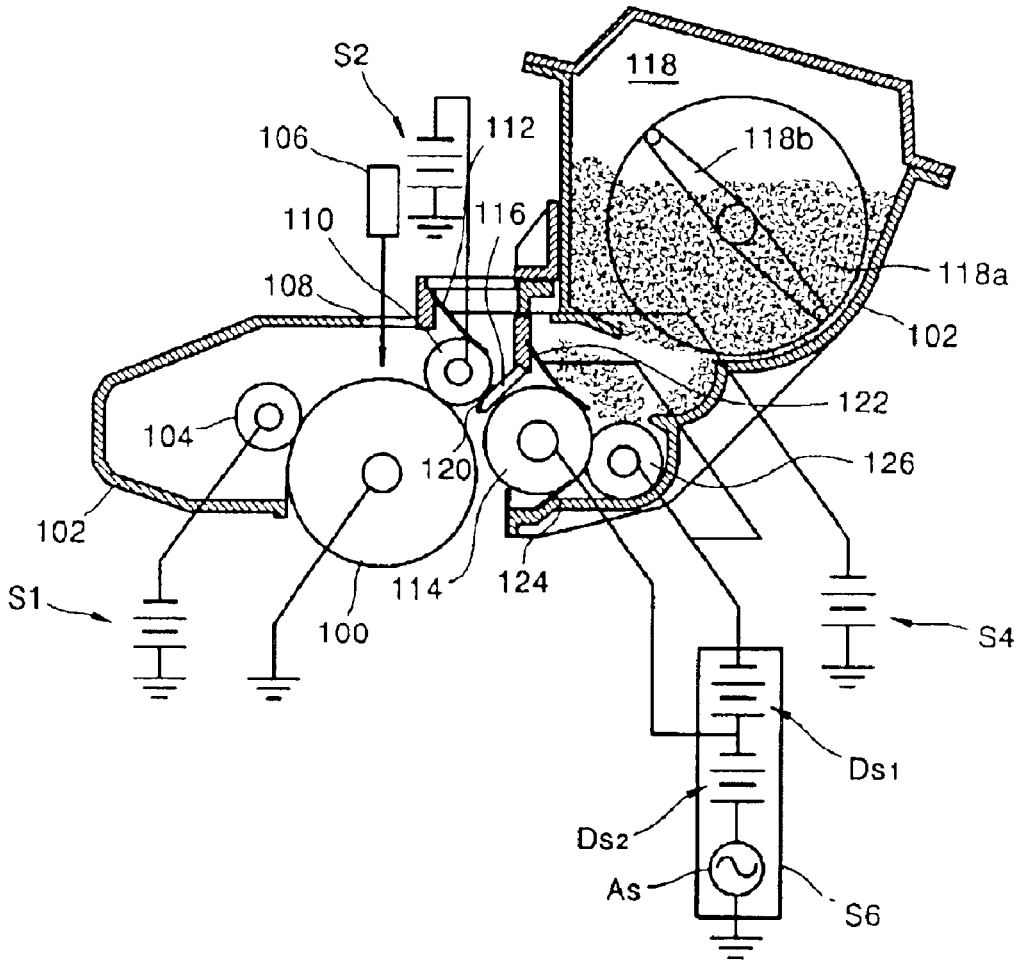

The structure of a third embodiment of the developing apparatus according to the present invention as shown in FIG. 5, is almost the same as that of the first embodiment of FIG. 3. Also, first toner layer control member 122 is connected to a fourth power source S4 as shown in the second embodiment of FIG. 4.

However, the developing roller 114, the supply roller 126 and the second toner layer control member 122 are all connected to a sixth power source S6 that includes first and second DC power source Ds1 and Ds2, and an AC power source As. In detail, the developing roller 114 is connected between the first and second DC power sources Ds1 and Ds2 of the sixth power source S6 so that a DC voltage of the DC power sources Ds1 and Ds2 overlapped with an AC voltage of the AC power source As is supplied to the developing roller 114. Also, the supplying voltage supplied to the supply roller 126 and the second control voltage of the second toner layer control member 122 are the same as or greater in the absolute value than the developing voltage supplied to the developing roller 114 from the sixth power source S6. As a result, since the electric potential of the circumference of the supply roller 126 is at least the same as or larger in the absolute value than the electric potential of the circumference of the developing roller 114, toner can be supplied regularly and easily from the circumference of the supply roller 126 to the circumference of the developing roller 114. As a result, it is possible to obtain an image of good quality although a number of images are repeatedly formed and developed.

Hereinafter, a method of forming an image using the above-described developing apparatus according to the embodiments of the present invention, will be described with reference to FIGS. 3 and 6.

Figure 6:
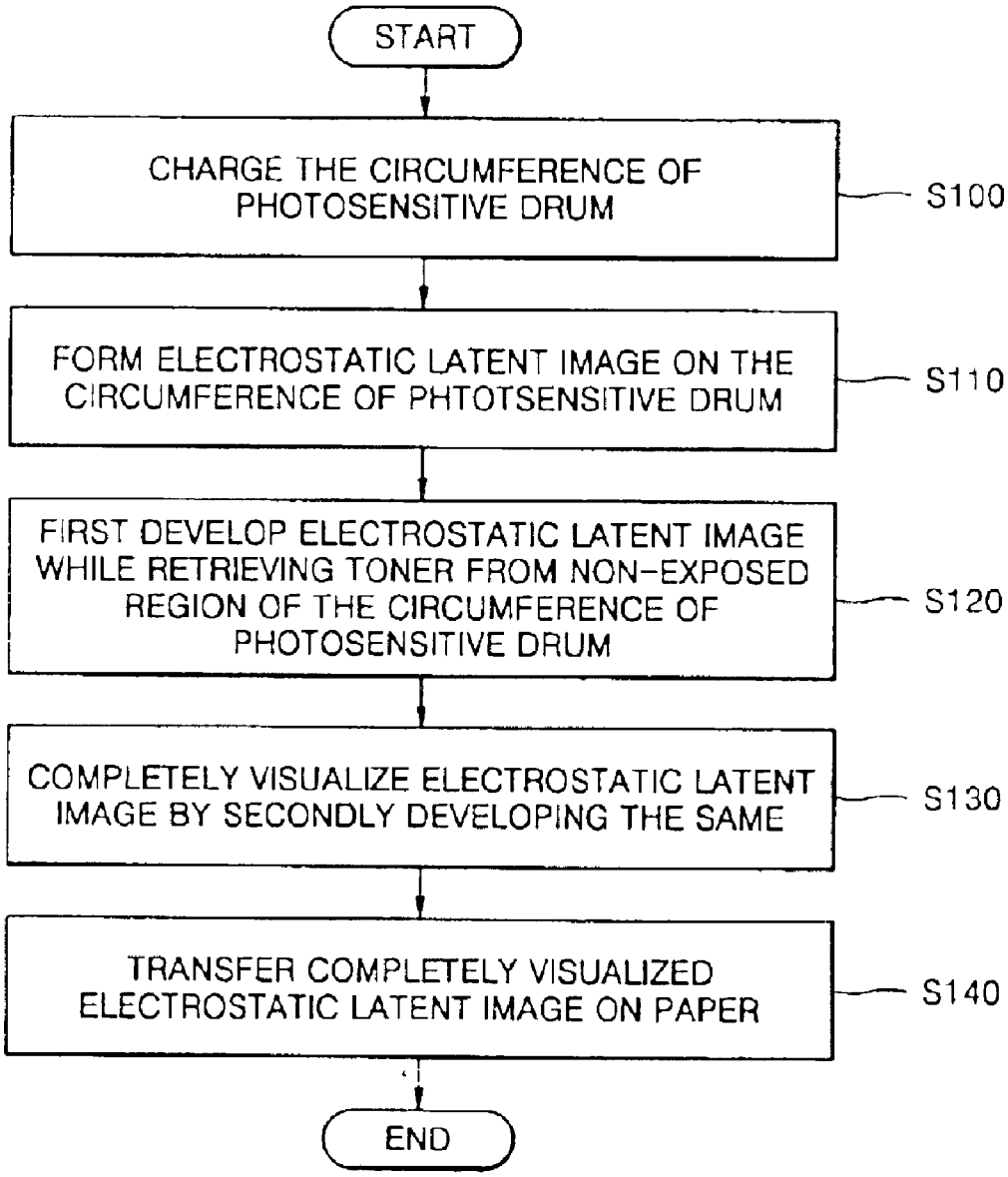
FIG. 6 is a flow chart explaining a method of forming an image in the developing apparatus of the image forming apparatus of FIGS. 3 through 5.

FIG. 6 is a flow chart explaining a method of forming an image with a developing apparatus in an image forming apparatus using electrophotography. Referring to FIG. 6, the circumference of the photosensitive drum 100 is charged with electric charge in operation S100. In response to an image forming initial signal, the photosensitive drum 100 rotates, and then its circumference is charged with a first electric potential by a charging roller 104.

Then, a predetermined latent electrostatic image is formed on the charged circumference of the photosensitive drum 100 in operation S110. The circumference of the photosensitive drum 100, which is charged with the first electric potential, rotates to reach the bottom of the light scanning unit 106, and light containing an image is scanned on the circumference via the photosensitive drum 100. Then, a predetermined image region (exposed portion) of a second electric potential, which is lower in absolute value than the first electric potential, is formed on the circumference of the photosensitive drum 100 that is charged with the first electric potential. The predetermined image region of the second electric potential is an image region having a latent electrostatic image corresponding to the image.

Next, the latent electrostatic image is primarily developed while retrieving toner from a non-exposed portion (non-image region) of the circumference of the photosensitive drum 100 in operation S120. In detail, as the photosensitive drum 100 rotates, predetermined voltage is supplied to its circumference from the second power source S2. As a result, the circumference comes in contact with the retrieving/auxiliary developing roller 110 charged with a third electric potential. The electric potential of the retrieving/auxiliary developing roller 110, i.e., the third electric potential, has the relationship with the first and second electric potentials as follows:

$$|\text{second electric potential}|<|\text{third electric potential}|<|\text{first electric potential}|$$

Therefore, when the circumference of the retrieving/auxiliary developing roller 110 is in contact with the circumference of the photosensitive drum 100, toner remaining on the non-image region of the circumference of the photosensitive drum 100, which is charged with the first electric potential, i.e., the non-image region where the latent electrostatic image is not formed, is transferred to the circumference of the retrieving/auxiliary developing roller 110, the electric potential of which is lower in absolute value than that of the circumference of the photosensitive drum 100. Then, the remnant toner is retrieved from the non-image region of the first electric potential of the circumference of the photosensitive drum 100. The amount of the electrification and toner layers of the retrieved toner can be regulated and controlled by the first toner layer control member 112.

Then, the toner is re-distributed regularly throughout the circumference of the retrieving/auxiliary developing roller 110 by the first toner layer control member 112. Next, the toner is transferred to the region having the second electric potential of the photosensitive drum 100 on which the latent electrostatic image is formed, due to a difference of electric potentials between the circumferences of the retrieving/auxiliary developing roller 110 and the photosensitive drum 100. Therefore, the latent electrostatic image become developed primarily and then is partially visualized.

Next, the primarily developed latent electrostatic image is secondly developed and then completely visualized in operation S130. In detail, the partially visualized latent electrostatic image is secondly developed when passing through the developing roller 114, and then is completely visualized. At this time, a gap is formed between the circumference of the developing roller 114 and the circumference of the photosensitive drum 100. The circumference of the developing roller is charged with a fourth electric potential whose absolute value is higher than that of the second electric potential. For instance, assuming that the second electric potential is −100 V, the fourth electric potential is −250 V. A third power source S includes a DC power source Ds and an AC power source As, and therefore, the fourth electric potential is considered as being made by overlapping an electric potential from the third power source S3 and an electric potential from an AC power source As. Therefore, toner is regularly transferred from the circumference of the developing roller 114 to the image region of the circumference of the photosensitive drum 100 on which the latent electrostatic image is partially visualized. Here, the non-image region of the circumference of the photosensitive drum 100, which is charged with the first electric potential, is higher in absolute value than the electric potential of the circumference of the developing roller 114. For this reason, the toner is not transferred to the non-image region of the circumference of the photosensitive drum 100 that is charged with the first electric potential.

Lastly, the completely visualized latent electrostatic image (hereinafter, "first image") is transferred onto paper in operation S140. In detail, while one surface of the paper supplied by a paper feeding apparatus (not shown) is in contact with the circumference of the photosensitive drum 100 on which the first image is formed, a voltage whose polarity is opposite to that of the toner is supplied to the other surface of paper. As a result, the toner, which is developed on the circumference of the photosensitive drum 100, i.e., the first image, is transferred onto the paper. However, in the case of a color image forming apparatus, the first image is transferred onto the paper through an intermediate transferring process of forming each color image. If the paper passes through a heating roller (not shown), the toner transferred onto the paper is fixed on the paper, and then, a desired image is finally formed thereon.

In the above method of forming an image, with the first toner layer control means 112 being connected to a fourth power source S4, the supply roller 126 and the second toner layer control member 122 can be connected to a fifth power source S5. In this case, it is possible that the supplying voltage is supplied to the supply roller 126 so that the absolute value of the electric potential, which is formed on the circumference of the supply roller 126, is higher than the absolute value of the electric potential formed on the circumference of the developing roller 114.

Meanwhile, the first toner layer control member 112 is connected to the fourth power source S4, and the supply roller 126 and the second toner layer control member 122 can be connected to the sixth power source S6.

In the drawings and specification, there have been disclosed embodiments of the invention and, although specific terms are employed, they are used in a generic and descriptive sense only and not for purpose of limitations, the scope of the invention being set forth in the following claims. For instance, it is regarded that those skilled in a technical field to which the present invention belongs, may replace a fifth power source supplying the same voltage both to a supply roller and second toner layer control member disclosed in the second embodiment, with several power sources supplying the supplying voltage and the second control voltage to the supply roller and the second toner layer control member, respectively. Also, the sixth power source disclosed in the third embodiment can be replaced with several power sources supplying the supplying voltage and the second control voltage to the supply roller and the second toner layer control member, respectively.

As described above, in a developing apparatus adapted for use in an image forming apparatus according to the present invention, toner remaining along the circumference of a photosensitive drum is retrieved to be used in developing a latent electrostatic image. Thus, since no additional cleaning devices are required and no waste toner is generated, the developing apparatus does not require an additional space for storing the waste toner, thereby reducing the developing apparatus in size. Also, the retrieved remnant toner is used again, thereby minimizing the consumption of new toner. Further, a retrieving ratio of the remnant toner can be increased by controlling a retrieving/auxiliary developing roller to be in contact with a photosensitive drum, and an image of high definition can be formed while not contacting the retrieving/auxiliary developing roller with a developing roller. Because there is no need for an additional region for storing the waste toner, it is possible to prevent any inconvenience of a user and the contamination of an image or the pollution of environments due to the leakage of the waste toner. Lastly, in the developing apparatus according to the present invention, the structure and functions of conventional developing apparatuses are improved, so that the life of the developing apparatus can be lengthened irrespective of a waste toner storage region.

Although a few preferred embodiments of the present invention have been shown and described, it would be appreciated by those skilled in the art that changes may be made in this embodiment without departing from the principles and spirit of invention, the scope of which is defined in the claims and their equivalents.

What is claimed is:

1. A developing apparatus in an image forming apparatus having a photosensitive drum with a non-image region, on which a latent electrostatic image is not formed, and an image region, on which the latent electrostatic image is formed, the developing apparatus comprising:

a retrieving/auxiliary developing roller being in contact with a circumference of the photosensitive drum, retrieving toner remaining on the non-image region of the circumference of the photosensitive drum on which the latent electrostatic image is not formed, and first developing the image region of the latent electrostatic image;

a first toner layer control member uniformly re-distributing and electrifying the retrieved toner on a circumference of the retrieving/auxiliary developing roller;

a developing roller having a gap with the circumference of the photosensitive drum, secondly developing the firstly developed latent electrostatic image so as to completely visualize the latent electrostatic image;

a supply roller supplying new toner to the developing roller; and a second toner layer control member regularly coating the toner supplied by the supply roller throughout the circumference of the developing roller, and regulating the amount of electrification of the new toner coated on the developing roller.

2. The developing apparatus of claim 1, wherein a linear velocity ratio of the circumference of the retrieving/auxiliary developing roller with respect to the circumference of the photosensitive drum is between 1–2 inclusive.

3. The developing apparatus of claim 2, further comprising:

a power source supplying a predetermined voltage to the retrieving/auxiliary developing roller so as to retrieve the toner remaining on the non-image region of the circumference of the photosensitive drum and to firstly develop the latent electrostatic image; and another power source supplying the first toner layer control member with a first control voltage having an absolute value being equal to or greater than that of the predetermined voltage supplied to the retrieving/auxiliary developing roller.

4. The developing apparatus of claim 3, further comprising a power source connected to the developing roller, the supply roller and the second toner layer control member, wherein the power source supplies a developing voltage to the developing roller so that an absolute value of an electric potential of the circumference of the developing roller is greater than that of an electric potential of the image region of the latent electrostatic image, and the power source supplies the supply roller and the second toner layer control member with a supplying voltage and a second control voltage, respectively, each having an absolute value being equal to or greater than that of the developing voltage supplied to the developing roller.

5. The developing apparatus of claim 4, wherein the electric potential of the circumference of the retrieving/auxiliary developing roller has a relationship with the electric potential of the image region of the latent electrostatic image formed on the circumference of the photosensitive drum and the electric potential of the non-image region as follows:

$$|V_L|<|V_{B1}|<|V_0|]$$

wherein $V_L$, $V_{B1}$, $V_0$ denote the electric potentials of the image region of the circumference of the photosensitive drum, the circumference of the retrieving/auxiliary developing roller, and the non-image region of the circumference of the photosensitive drum, respectively.

6. The developing apparatus of claim 4, wherein the power source, which is connected to the developing roller, the supply roller and the second toner layer control member comprises:

an AC power source;

a first DC power source;

a second DC power source;

the AC and second DC power sources supplying the developing voltage made by overlapping DC and AC voltages to the developing roller; and the first DC power source supplying the supplying roller and the second toner layer control member with the supplying voltage and the second control voltage, respectively, each having an absolute value being equal to or greater than that of the developing voltage supplied to the developing roller.

7. The developing apparatus of claim 1, wherein a predetermined voltage is supplied to the retrieving/auxiliary developing roller, the developing apparatus further comprising a power source supplying the supply roller and the second toner layer control member with a supplying voltage and a second control voltage, respectively, wherein the supplying voltage and the second control voltage each has an absolute value being equal to or greater than that of the predetermined voltage.

8. The developing apparatus of claim 1, wherein the retrieving/auxiliary developing roller is a conductive elastic roller having a surface resistance less than $5\times10^8$ Ω.

9. The developing apparatus for use in of claim 1, wherein the developing roller is one of an aluminum roller that is electroplated with nickel and a rubber roller, and the aluminum roller has a surface roughness of 3 or less.

10. A method of forming an image in a developing apparatus of an image forming apparatus, which includes a retrieving/auxiliary developing roller primarily developing a latent electrostatic image while retrieving toner remaining around the latent electrostatic image formed on a circumference of a photosensitive drum, a first toner layer control member uniformly re-distributing and electrifying the retrieved toner on a circumference of the retrieving/auxiliary developing roller, a developing roller developing and visualizing the latent electrostatic image while keeping a predetermined gap with a circumference of the photosensitive drum, and a supply roller supplying toner to the developing roller, wherein the circumference of the photosensitive drum is charged with a first electric potential in response to an image forming initial signal, and then an image region of the circumference of the photosensitive drum is charged with a second electric potential to form the latent electrostatic image, and a third electric potential is applied on the circumference of the retrieving/auxiliary developing roller, and wherein the first through third electric potentials have a following relationship:

$$|\text{second electric potential}|<|\text{third electric potential}|<|\text{first electric potential}|.$$

11. The method of claim 10, further comprising:

maintaining a linear velocity ratio of the circumference of the retrieving/auxiliary developing roller with respect to the circumference of the photosensitive drum to be between 1–2 inclusive.

12. The method of claim 11, further comprising:

regulating a toner layer of the circumference of the retrieving/auxiliary developing roller by using a first toner layer control member being in contact with the circumference of the retrieving/auxiliary developing roller; and supplying the first toner layer control member with a first control voltage having an absolute value being equal to or greater than that of the third electric potential supplied to the retrieving/auxiliary developing roller so as to keep or increase toner friction characteristics of the first toner layer control member.

13. The method of claim 12, further comprising:

regulating the charging amount of toner on the developing roller by a second toner layer control member; and supplying the supply roller and the second toner control member with a supplying voltage and a second control voltage, respectively, each having an absolute value being equal to or greater than that of the developing voltage supplied to the developing roller.

14. The method of claim 12, further comprising:

supplying the developing roller with a developing voltage so that an absolute value of an electric potential of a circumference of the developing roller is greater than the absolute value of the electric potential of the latent electrostatic image; and supplying the supply roller and a second toner layer control member with a supplying voltage and a second control voltage, respectively, each having an absolute value being equal to or greater than that of the developing voltage supplied to the developing roller.

15. The method of 10, further comprising:

charging the circumference of the photosensitive drum with the first electric potential in response to an image forming initial signal;

forming the image region of the latent electrostatic image having the second electric potential on the circumference of the photosensitive drum;

partially visualizing the latent electrostatic image by using the retrieving/auxiliary developing roller;

completely visualizing the partially visualized latent electrostatic image by the developing roller; and transferring and fixing the completely visualized latent electrostatic image onto paper.

16. The method of claim 15, wherein the partially visualizing includes firstly developing the latent electrostatic image while retrieving toner from the non-image region of the circumference of the photosensitive drum, which is charged with the first electric potential.

17. The method of claim 16, further comprising:

supplying the developing roller with a developing voltage using a DC voltage source and an AC voltage source so as to secondly develop the firstly developed latent electrostatic image.

18. The method of claim 17, further comprising:

controlling a linear velocity ratio of the circumference of the retrieving/auxiliary developing roller with respect to the circumference of the photosensitive drum to be between 1–2 inclusive.

* * * * *